United States Patent [19]

Fellwock et al.

[11] Patent Number: 4,914,928

[45] Date of Patent: Apr. 10, 1990

[54] MANUAL AIR DAMPER CONTROL FOR A REFRIGERATOR

[75] Inventors: Charles G. Fellwock, Scott Township, Vanderburgh County; David A. Biggs, Knight Township, Vanderburgh County, both of Ind.

[73] Assignee: Whirlpool Corporation, Benton Harbor, Mich.

[21] Appl. No.: 237,377

[22] Filed: Aug. 29, 1988

[51] Int. Cl.[4] ..... F25D 17/04

[52] U.S. Cl. ..... 62/408; 62/441

[58] Field of Search ..... 62/187, 408, 441

[56] References Cited

U.S. PATENT DOCUMENTS

| | | | |
|---|---|---|---|
| 3,793,847 | 2/1974 | Scarlett et al. | 62/408 X |
| 3,866,437 | 2/1975 | Spencer | 62/408 |
| 4,642,998 | 2/1987 | Kang et al. | 62/408 X |
| 4,768,353 | 9/1988 | Bushser | 62/408 |

*Primary Examiner*—Lloyd L. King

*Attorney, Agent, or Firm*—Mason, Kolehmainen, Rathburn & Wyss

[57] ABSTRACT

A manual air damper control for a refrigerator is provided to convert rotary motion of a control knob disposed on a front panel in the refrigerator compartment into linear motion of an air damper disposed at the rear of the refrigerator compartment to operate the air damper in a limited space. The control includes a cam having a cam shaft on which the control knob is mounted and having a cam surface engaged by a cam following fork formed in one end of a pivot arm. The opposite end of the pivot arm engages a connecting rod which extends from the front of the refrigerator compartment to the rear thereof where the connecting rod engages the air damper to slide the air damper toward and away from the front of the refrigerator compartment. The air damper is a slide baffle which cooperates with an air passageway disposed between the refrigerator and freezer compartments so as to form a trapezoidally shaped opening into the refrigerator compartment to provided a controlled linear flow of air as the air damper is displaced.

14 Claims, 2 Drawing Sheets

MANUAL AIR DAMPER CONTROL FOR A REFRIGERATOR

BACKGROUND OF THE INVENTION

1. Field of the Invention

The present invention relates to a refrigerator and more particularly to a manual air damper control for a refrigerator that converts rotary motion of a control knob into linear motion of an air damper to operate the damper in a limited space.

2. Description of the Prior Art

Known refrigerators typically include a freezer compartment separated from a refrigerator compartment by a partition wall. To cool the refrigerator compartment, cool air is directed from the freezer compartment into the refrigerator compartment through an air passageway disposed in the partition wall. A damper mounted with respect to the air passageway is typically employed to regulate the amount of air flow into the refrigerator compartment to control the temperature thereof. The damper may be automatically controlled by a temperature sensitive control unit as shown in U.S Pat. No. 3,375,679 and U.S. Pat. No. Re. 27,990. Alternatively, the damper may be manually controlled as shown in the following patents. U.S. Pat. No. 3,093,981 shows a pivotal damper for a refrigerator, the damper position being manually controlled by a wheel cooperating with a pair of gears. U.S. Pat. No. 3,126,717 shows a damper slidably mounted with respect to a triangular opening of an air passageway to obtain a linear control of air flow into the refrigerator compartment as the damper is moved from its open position. U.S. Pat. No. 3,339,377 shows a pivotal damper for a refrigerator with a Bowden wire cable for translating linear movement of a manually actuated slider into pivotal movement of the damper. Further, U.S. Pat. No. 3,403,533 shows a manually controlled rotatable damper for a refrigerator. None of these manually controlled air dampers, however, provides a controlled linear air flow in a limited space in response to a rotatable control knob.

SUMMARY OF THE INVENTION

In accordance with the present invention, the disadvantages of prior air damper controls for a refrigerator have been overcome. The manual air damper control of the present invention converts the rotary motion of a control knob into linear motion of a slidable air damper to operate the damper in a limited space while providing a controlled linear air flow into the refrigerator compartment.

The air damper of the present invention is mounted for slidable movement over an outlet of an air flow passageway disposed in the partition wall between the freezer and refrigerator compartments wherein the outlet of the air flow passageway is disposed in the refrigerator compartment near the rear thereof. A connecting rod is coupled to the air damper and extends forward towards the front of the refrigerator compartment where the connecting rod engages one end of a pivot arm. The opposite end of the pivot arm has a cam following fork, the pivot point of the pivot arm being located between the end of the pivot arm engaging the connecting rod and the end of the pivot arm forming the cam following fork. A cam is provided with a cam surface that is engaged by the cam following fork of the pivot arm. The cam is rotated by a rotatable control knob mounted on a front panel of the refrigerator for easy accessibility. As the cam rotates, pivoting the pivot arm, the connecting rod is linearly displaced to, in turn, linearly displace the air damper to regulate the amount of air flow into the refrigerator.

The air damper of the present invention is preferably a slide baffle which cooperates with the outlet of the air passageway to provide a trapezoidal opening into the refrigerator compartment. The trapezoidal opening provides a controlled linear flow of air into the refrigerator compartment as the slide baffle is displaced.

These and other objects, advantages and novel features of the present invention, as well as details of an illustrated embodiment thereof, will be more fully understood from the following description and the drawing.

DESCRIPTION OF THE PREFERRED EMBODIMENT

Figure 1:
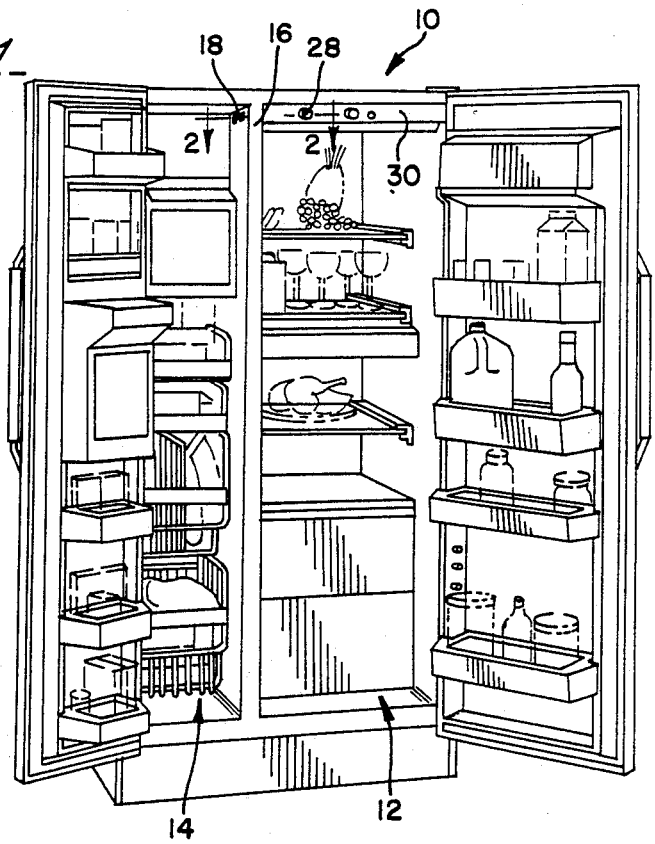
FIG. 1 is a perspective view of a refrigerator employing a manual air damper control constructed in accordance with the principles of the present invention.

A refrigerator 10 employing the manual air damper control constructed in accordance with the principles of the present invention is shown in FIG. 1 having a side-by-side configuration with a vertically extending refrigerator compartment 12 separated from a vertically extending freezer compartment 14 by a partition wall 16. To cool the refrigerator compartment 12, cool air from the freezer compartment 14 is directed into a cool air inlet 18 mounted in the freezer compartment 14 on the partition wall 16. The cool air from the freezer compartment 14 entering the inlet 18 flows through an air passageway 20 shown in FIG. 2 that extends through the partition wall 16 to an air outlet 22 disposed on the partition wall 16 in the refrigerator compartment 12. An air damper 24 is slidably mounted with respect to the outlet 22 of the air passageway 20, as described in detail below, to regulate the amount of air flow into the refrigerator compartment 12 from the freezer compartment 14 so as to control the temperature of the refrigerator compartment 12. The outlet 22 of the air passageway 20 is disposed in the partition wall 16 near a rear wall 26 of the refrigerator compartment 12. A rotatable control knob 28 is mounted on a front panel 30 disposed in the refrigerator compartment 12 parallel to the rear wall 26 but near the front of the refrigerator compartment 12 so that the control knob 28 is easily accessible by a user. The control for the air damper 24 as described in detail below with respect to FIGS. 2–4 converts rotary motion of the control knob 28 into linear motion of the air damper 24 to operate the air damper 24 at the rear of the refrigerator compartment 12 in a very limited space.

Figure 2:
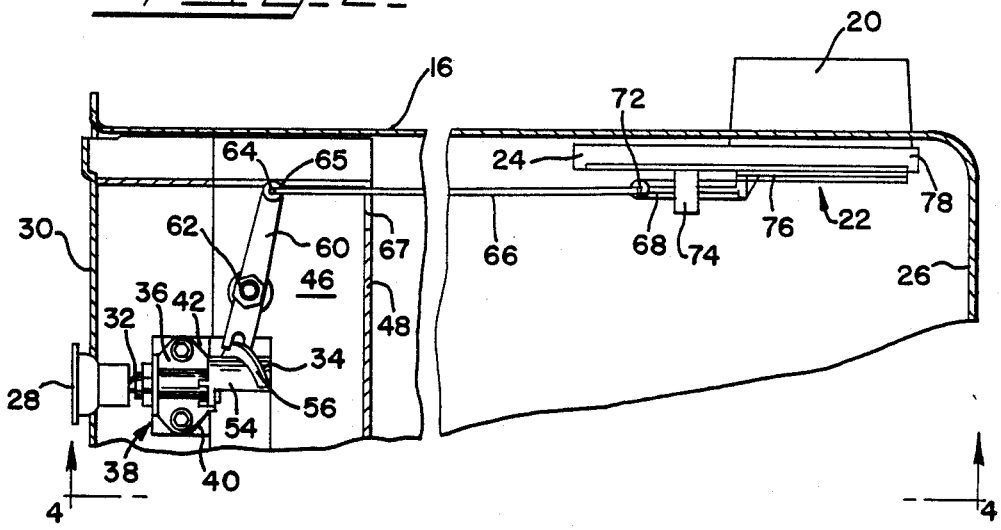
FIG. 2 is a top view of the manual air damper control taken along lines 2—2 of FIG. 1 illustrating a first position of the air damper control.
Figure 3:
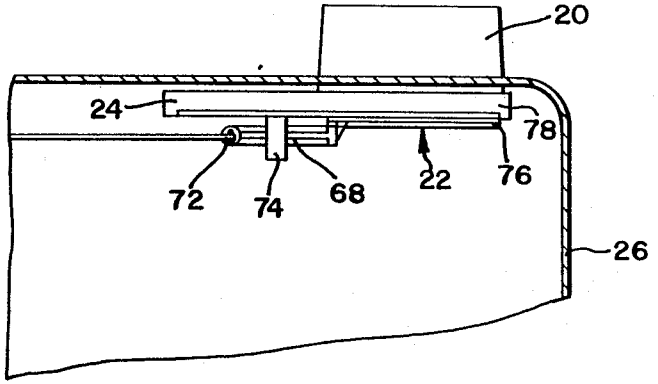
FIG. 3 is a top view of the air damper control illustrating a second position of the air damper control.
Figure 3:
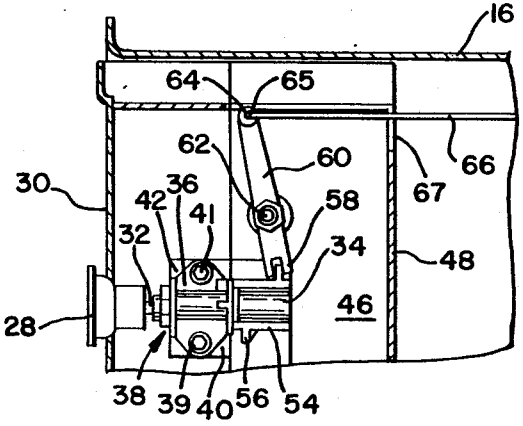
Figure 4:
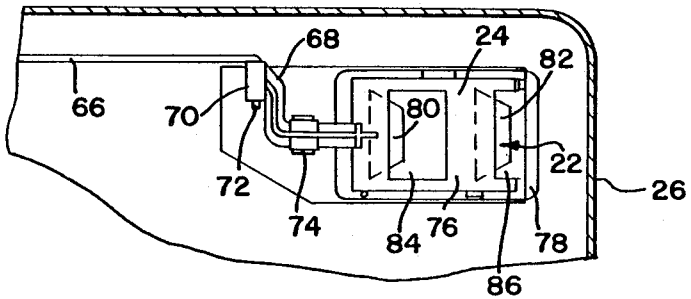
FIG. 4 is a side view of the manual air damper control shown in FIG. 2.
Figure 4:
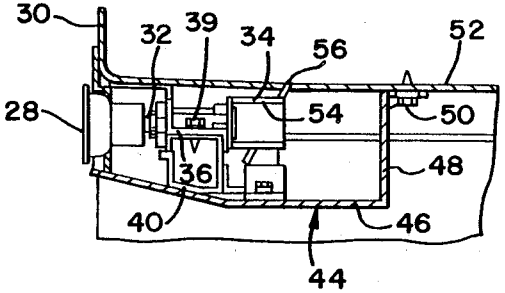

As shown in FIGS. 2–4, the control knob 28 is mounted on a shaft 32 of a cam 34 wherein the cam shaft 32 extends through a bearing body 36. The bearing body 36 is secured to a retainer dampener formed of a spring clip 38 having arms 40 and 42 disposed on opposite sides of the cam shaft 32 by respective screws 39 and 41. The spring clip 38 mounts the bearing body 36 to a mounting bracket 44 having a base 46 extending back from the front panel 30 to an upstanding flange 48 that is secured by a screw 50 to a top wall 52 of the refrigerator compartment 12.

The cam 34 has a semi-cylindrical side wall 54 with a flange 56 helically disposed about the side wall 54 to form a cam surface that is rotatable about the axis of the cam shaft 32. The cam surface formed by the flange 56 is engaged by a cam following fork 58 formed in one end of a pivot arm 60. The pivot arm 60 is pivotally secured to the base 46 of the mounting bracket 44 by a screw spacer 62 which allows the pivot arm 60 to pivot about the axis of the screw spacer 62. The end of the pivot arm 60 opposite the cam following fork 58 is formed having an aperture 64 into which an end 65 of a connecting rod 66 extends to couple the connecting rod 66 to the pivot arm 60. The connecting rod 66 extends from the front of the refrigerator compartment 12, near the front panel 30, through an opening 67 in the upstanding flange 48 of the mounting bracket 44 and generally parallel to the partition wall 16 to the rear of the refrigerator compartment 12 where the connecting rod 66 is coupled to the air damper 24.

The air damper 24 is a baffle having a slide member 68 with an aperture extending through one end 70 into which an end 72 of the connecting rod 66 extends. The baffle slide member 68 curves down and back through a baffle guide 74 to a slidable baffle plate 76. The baffle plate 76 extends in front of the body 78 of the baffle wherein the baffle body 78 is mounted on the partition wall 16. The baffle body 78 cooperates with the air passageway 20 and rectangular openings 84 and 86 formed in the baffle plate 76 to provide an air outlet 22 into the refrigerator compartment 12 with trapezoidally shaped openings 80 and 82. The trapezoidally shaped openings 80 and 82 which become enlarged as the baffle plate 6 is slid towards the front of the refrigerator compartment 2, provide controlled linear air flow into the refrigerator compartment 12 as the damper 24 is opened.

To open the air damper 24 by sliding the baffle plate 76 forward from the position depicted in FIG. 2 to the position depicted in FIG. 3, the control knob 28 is rotated in a counter-clockwise direction. As the control knob 28 is rotated in the counter-clockwise direction, the cam surface formed by the flange 56 is rotated about the axis of the cam shaft 32 causing the pivot arm 60 to pivot about the axis of the screw spacer 62 from the position depicted in FIG. 2 to the position depicted in FIG. 3, pulling the connecting arm 66 toward the front panel 30 of the refrigerator compartment 12. As the connecting rod 66 is pulled toward the front panel 30 along a line generally parallel to the partition wall 16, the connecting rod 66 and baffle slide member 68 slide the baffle plate 76 forward across the baffle body 78 to expand the trapezoidal openings 80 and 82. The cam 34, pivot arm 60 and connecting rod 66 thus convert rotary motion of the control knob 28 into linear motion of the air damper 24 to provide a controlled linear flow of air as the air damper 24 is displaced.

Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

1. A refrigeration apparatus comprising:

a freezer compartment;

a refrigerator compartment separated from said freezer compartment by a partition wall and having a front panel extending generally perpendicular to the partition wall;

an air flow passageway disposed in said partition wall between said freezer and refrigerator compartments with an outlet in the partition wall a distance in back of said front panel;

an air damper mounted for slidable movement over said air flow passageway outlet to regulate the amount of air flow into said refrigerator compartment;

a connecting rod coupled to said air damper and extending towards said front panel;

a pivot arm having a first end engaging said connecting rod, a second end having a cam following surface and a pivot point between said first and second ends;

a cam having a cam surface engaged by the second end of said pivot arm; and a control knob mounted for rotation on said front panel and coupled to said cam to impart rotation thereto pivoting said pivot arm to move said connecting rod and said air damper back and forth to regulate the amount of air flow into said refrigerator.

2. A refrigeration apparatus as recited in claim 1 wherein said cam surface is rotatable about an axis generally parallel to said partition wall.

3. A refrigeration apparatus as recited in claim 2 wherein said cam has a semi-cylindrical side wall with a flange helically disposed about said side wall to form said cam surface.

4. A refrigeration apparatus as recited in claim 3 wherein the second end of said pivot arm has a cam following fork for engaging the flange of said cam.

5. A refrigeration apparatus as recited in claim 1 wherein said outlet has a trapezoidally shaped opening.

6. A refrigeration apparatus as recited in claim 1 wherein said air damper is a slide baffle which cooperates with said outlet to provide a trapezoidal opening into said refrigerator compartment.

7. A refrigeration apparatus comprising:

a freezer compartment;

a refrigerator compartment separated from said freezer compartment by a side wall and having a rear wall and a front panel extending generally perpendicular to said side wall respectively at the rear and front of said refrigerator compartment;

an air flow passageway disposed in said side wall between said freezer and refrigerator compartments with an outlet in said side wall near said rear wall;

an air damper mounted for slidable movement over said air flow passageway outlet to regulate the amount of air flow into said refrigerator compartment;

a connecting rod having a first end coupled to said air damper and having a second end;

a pivot arm having a first end engaging the second end of said connecting rod, a second end having a cam following surface and a pivot point between said first and second ends;

a cam having a cam surface engaged by the second end of said pivot arm and rotatable about an axis generally parallel to said side wall; and a control knob mounted for rotation on said front panel and coupled to said cam to impart rotation thereto pivoting said pivot arm to move said connecting rod and said air damper back and forth to regulate the amount of air flow into said refrigerator.

8. A refrigeration apparatus as recited in claim 7 wherein said cam has a semi-cylindrical side wall with a flange helically disposed about said side wall to form said cam surface.

9. A refrigeration apparatus as recited in claim 8 wherein the second end of said pivot arm has a cam following fork for engaging the flange of said cam.

10. A refrigeration apparatus as recited in claim 7 wherein said outlet has a trapezoidally shaped opening.

11. A refrigeration apparatus as recited in claim 7 wherein said air damper is a slide baffle which cooperates with said outlet to provide a trapezoidal opening into said refrigerator compartment.

12. A refrigeration apparatus as recited in claim 7 further including a mounting bracket extending back from said front panel; and dampener means for securing said cam to said mounting bracket.

13. A refrigeration apparatus as recited in claim 12 further including a screw spacer for pivotally securing said pivot arm to said mounting bracket.

14. A side-by-side refrigerator comprising:

a freezer compartment;

a refrigerator compartment separated from said freezer compartment by a partition wall and having a front panel extending generally perpendicular to the partition wall;

an air flow passageway disposed in said partition wall between said freezer and refrigerator compartments with an outlet in the partition wall a distance in back of said front panel;

an air damper mounted for slidable movement over said air flow passageway outlet to regulate the amount of air flow into said refrigerator compartment, said air damper cooperating with said air flow passageway outlet to provide a controlled linear flow of air into said refrigerator compartment;

a control knob mounted for complete rotation on said front panel; and means for converting rotary motion of said control knob into linear motion of said air damper to provide a controlled, linear flow of air into said refrigerator compartment.

* * * * *